US005266233A

United States Patent [19]

Houghton et al.

[11] Patent Number: 5,266,233

[45] Date of Patent: Nov. 30, 1993

[54] METHOD OF WASHING FABRICS IN AUTOMATIC DOSING MACHINE

[75] Inventors: Mark P. Houghton, Rotterdam; Willem Oldenburg, CE Maassluis, both of Netherlands

[73] Assignee: Lever Brothers Company, New York, N.Y.

[21] Appl. No.: 805,253

[22] Filed: Dec. 9, 1991

[30] Foreign Application Priority Data

Dec. 10, 1990 [EP] European Pat. Off. ..... 90203233

[51] Int. Cl.[5] ..... D06L 1/20; D06F 39/02; C11D 1/66; C11D 3/395

[52] U.S. Cl. ..... 252/174.21; 252/162; 252/544; 252/174.17; 252/104; 252/90; 8/137

[58] Field of Search ..... 252/162, 544, 174.17, 252/174.21, 104, 90; 8/137

[56] References Cited

U.S. PATENT DOCUMENTS

| | | | |
|---|---|---|---|
| 3,850,831 | 11/1974 | Hellsten et al. | 252/104 X |
| 4,110,075 | 8/1978 | Graf et al. | 8/137 |
| 4,749,512 | 6/1988 | Broze et al. | 252/174.21 X |
| 4,889,644 | 12/1989 | Amberg et al. | 8/137 X |

FOREIGN PATENT DOCUMENTS

| | | |
|---|---|---|
| 0266199 | 5/1988 | European Pat. Off. . |
| 295525 | 6/1988 | European Pat. Off. . |
| 0392197 | 10/1990 | European Pat. Off. . |
| 3242411 | 5/1984 | Fed. Rep. of Germany . |
| 1569697 | 6/1980 | United Kingdom . |

*Primary Examiner*—W. J. Shine
*Assistant Examiner*—Douglas J. McGinty
*Attorney, Agent, or Firm*—Ronald A. Koatz

[57] ABSTRACT

Use is disclosed of a non-aqueous liquid detergent composition for the washing of fabrics in a domestic automatic dosing washing machine.

3 Claims, No Drawings

METHOD OF WASHING FABRICS IN AUTOMATIC DOSING MACHINE

The present invention relates to a method of washing fabrics, in particular to a method of washing fabrics in a domestic washing machine of the automatic dosing type.

Domestic washing machines are washing machines which generally are used for the washing of fabrics under household conditions. Usually they have a washing capacity of 1-10 kg, generally 2-8 kg per wash cycle and use about 10-70 liters, generally 15-60 liters water per wash or rinse cycle. Suitable machines are for example top- or frontloading washing machines of the European or US-type.

Domestic washing machines of the automatic dosing type differ from ordinary domestic washing machines in that they either contain one or more reservoirs for detergent compositions or means for attaching one or more reservoirs to the machine, said reservoirs each being capable of containing a liquid detergent composition in an amount sufficient for several washing cycles, say 10-1000 cycles, generally 50-500 wash-cycles.

In use, generally, some information (for example type of fabric, desired washing temperature and the degree of soiling) is fed into the control system of the washing machine whereupon the machine determines the appropiate amounts of the detergent compositions to be used. These amounts are then dosed into the system by means of an automatic dosing system which effect the transfer of the appropiate amounts of detergent compositions from the reservoirs into the washing machine.

An example of a domestic washing machine of the automatic dosing type is disclosed in GB 1 569 697. Another example of a domestic automatic dosing system is the Siwamat plus electronic WE 49701 (ex Siemens). Detergent compositions for use in a domestic washing machine of the automatic dosing type preferably should satisfy most of the following requirements:

(a) they should preferably be concentrated enough such that a reservoir can contain a supply of detergent composition which suffices for a reasonable number (say 50 or more) of washing cycles.

(b) the detergent compositions should preferably be stable enough to allow the storage over a longer period in the reservoir without unacceptable destabilisaton. In particular the detergent composition should preferably be temperature stable and pumpable at temperatures of about 0°C. Also if the composition contains enzymes, these should preferably be stable over prolonged storage.

(c) the detergent compositions should preferably have a physical form which renders these suitable for use in an automatic dosing system.

(d) the detergent compositions should preferably be water hardness insensitive, such that the dosage to be used per wash cycle is reasonably independant of the water hardness.

Surpisingly it has now been found that non-aqueous liquid detergent compositions are particularly suitable for use in a domestic automatic dosing washing machine.

Accordingly the present invention relates to the use of a non-aqueous liquid detergent composition for the washing of fabrics in a domestic automatic dosing washing machine.

Non-aqueous liquid detergent compositions are liquid detergent compositions containing no or only little water. Generally the free water content of these products is less than 5 wt %, more preferably less than 2%, most preferably non-aqueous liquid detergent compositions are substantially free of water. Preferably the viscosity of the liquid is less than 5.0 Pa.s at 21 $s^{-1}$ more preferably less than 2.5 Pa.s, most preferably from 0.05 to 1.5 Pa.s somewhere in the temperature range of 0°-60°C., preferably at ambient temperature.

Non-aqueous liquid detergent compositions for use in a domestic automatic dosing system may be isotropic (free of dispersed solids) or may comprise a liquid phase in combination with a solid phase dispersed in the liquid phase. In that case the liquid phase preferably constitutes from 10 to 100% by weight, more preferably 20-80%, most preferably 30-60% by weight of the composition. The solid phase preferably constitutes from 0-90% by weight, more preferably 20-80%, most preferably 40-70% by weight of the composition.

Preferably the liquid phase of the non-aqueous detergent composition comprises a liquid nonionic surfactant. Nonionic detergent surfactants are well-known in the art. They normally consist of a water-solubilizing polyalkoxylene or a mono- or di-alkanolamide group in chemical combination with an organic hydrophobic group derived, for example, from alkylphenols in which the alkyl group contains from about 6 to about 12 carbon atoms, dialkylphenols in which each alkyl group contains from 6 to 12 carbon atoms, primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylenes. Also common are fatty acid mono- and dialkanolamides in which the alkyl group of the fatty acid radical contains from 10 to about 20 carbon atoms and the alkyloyl group having from 1 to 3 carbon atoms. In any of the mono- and di- alkanolamide derivatives, optionally, there may be a polyoxyalkylene moiety joining the latter groups and the hydrophobic part of the molecule. In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in the applicants'published European specification EP-A-225,654, especially for use as all or part of the liquid phase. Also preferred are those ethoxylated nonionics which are the condensation products of fatty alcohols with from 9 to 15 carbon atoms condensed with from 3 to 11 moles of ethylene oxide. Examples of these are the condensation products of $C_{11-13}$ alcohols with (say) 3 or 7 moles of ethylene oxide. These may be used as the sole nonionic surfactants or in combination with those of the described in the last-mentioned European specification, especially as all or part of the liquid phase.

Another class of suitable nonionics comprise the alkyl polysaccharides (polyglycosides/oligosaccharides) such as described in any of specifications U.S. Pat Nos. 3,640,998; 3,346,558; 4,223,120; EP-A-92,355; EP-A-99,183; EP 70,074, '76, '77; EP 75,994, '95, '96.

Mixtures of different nonionic detergent surfactants may also be used. Mixtures of nonionic detergent surfactants with other detergent surfactants such as anionic, cationic or ampholytic detergent surfactants and soaps may also be used.

Preferably the level of nonionic surfactants is from 10–90% by weight of the composition, more preferably from 20–70%, most preferably from 35 to 50%.

Examples of other liquid materials which may be present in the liquid phase are liquid bleach precursors such as for example glyceroltriacetate and solvent materials for example dodecanol. The level of liquid bleach precursors is preferably 0–20% by weight, more preferably 1–25%, most preferably 2–10%. The level of solvents other than nonionic surfactants is preferably from 0–20%, most preferably 0–15%, more preferably 0–10% by weight.

Preferably the solid phase of the liquid non-aqueous detergent composition—if any—comprises one or more ingredients selected from bleach materials, solid bleach activators, builders, deflocculants and minor ingredients such as fluorescers. The solid phase should be in particulate form and preferably have a weight average particle size of less than 300 microns, more preferably less than 100 microns, especially less than 10 microns. The particle size may even be of sub-micron size. The proper particle size can be obtained by using materials of the appropriate size or by milling the total product in a suitable milling apparatus.

Bleaches include the halogen, particularly chlorine bleaches such as are provided in the form of alkalimetal hypohalites, e.g. hypochlorites. In the application of fabrics washing, the oxygen bleaches are preferred, for example in the form of an inorganic persalt, preferably with a bleach precursor, or as a peroxy acid compound.

In the case of the inorganic persalt bleaches, the activator makes the bleaching more effective at lower temperatures, i.e. in the range from ambient temperature to about 60° C., so that such bleach systems are commonly known as low-temperature bleach systems and are well-known in the art. The inorganic persalt such as sodium perborate, both the monohydrate and the tetrahydrate, acts to release active oxygen in solution, and the activator is usually an organic compound having one or more reactive acyl residues, which cause the formation of peracids, the latter providing for a more effective bleaching action at lower temperatures than the peroxybleach compound alone. The ratio by weight of the peroxybleach compound to the activator is from about 20:1 to about 1:1, preferably from about 10:1 to about 1.5:1. The preferred level of the peroxybleach compound in the composition is from 0–30% by weight, more preferably 2–20%, most preferably 4–15%, while the preferred level of the activator is from 0–20% by weight, more preferably 1–10%, most preferably 2–8%.

Typical examples of the suitable peroxybleach compounds are alkalimetal perborates, both tetrahydrates and monohydrates, alkali metal percarbonates, persilicates and perphosphates, of which sodium perborate is preferred. A preferred bleach activator is TAED.

It is particularly preferred to include in the compositions, a stabiliser for the bleach or bleach system, for example ethylene diamine tetramethylene phosphonate and diethylene triamine pentamethylene phosphonate or other appropriate organic phosphonate or salt thereof, such as the Dequest range hereinbefore described. These stabilisers can be used in acid or salt form, such as the calcium, magnesium, zinc or aluminium salt form. The stabiliser may be present at a level of up to about 1% by weight, preferably between about 0.1% and about 0.5% by weight.

In a preferred embodiment of the invention, the non-aqueous liquid detergent composition for use in accordance with the present invention is substantially bleach-free, while the bleach components are present in a second composition in a separate reservoir. The separate dosing of bleach components and surfactants makes it possible to adapt the relative amounts of the two compositions to the washing conditions. For example the low temperature washing of coloured fabrics may be carried out without bleach; the washing of coloured fabrics at medium temperature may be carried out with a normal bleach to detergent active ratio, while the washing of white fabrics at high temperatures may be carried out wiht relative high amounts of bleach.

The detergency builders are those materials which counteract the effects of calcium, or other ion, water hardness, either by precipitation or by an ion sequestering effect. They comprise both inorganic and organic builders. They may also be sub-divided into the phosphorus-containing and non-phosphorus types, the latter being preferred when environmental considerations are important.

In general, the inorganic builders comprise the various phosphate-, carbonate-, silicate-, borate- and aluminosilicates-type materials, particularly the alkali-metal salt forms. Mixtures of these may also be used.

Examples of phosphorus-containing inorganic builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic builders, when present, include water-soluble alkali metal carbonates, bicarbonates, borates, silicates, metasilicates, and crystalline and amorphous aluminosilicates. Specific examples include sodium carbonate (with or without calcite seeds), potassium carbonate, sodium and potassium bicarbonates, silicates such as sodiummetasilicate and zeolites.

If zeolite materials are present, preferably the non-aqueous liquid detergent composition is substantially free of bleach; if desired the bleach can then be dosed as a separate component in the automatic dosing system.

Examples of organic builders include the alkali metal, ammonium and substituted ammonium, citrates, succinates, malonates, fatty acid sulphonates, carboxymethoxy succinates, ammonium polyacetates, carboxylates, polycarboxylates, aminopolycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid. Other examples are organic phosphonate type sequestering agents such as those sold by Monsanto under the tradename of the Dequest range and alkanehydroxy phosphonates.

Other suitable organic builders include the higher molecular weight polymers and co-polymers known to have builder properties, for example appropriate polyacrylic acid, polymaleic acid and polyacrylic/-polymaleic acid co-polymers and their salts, such as those sold by BASF under the Sokalan Trade Mark. Poluacrylates or their derivatives may also be useful for their antiashing properties.

Preferably the level of builder materials is from 0–50% by weight of the composition, more preferably 10–40%, most preferably 15–35%.

Preferably compositions of the invention also comprise a deflocculant material. In principle, any material may be used as a deflocculant provided it fulfils the deflocculation test described in European Patent Specification EP-A-266199 (Unilever). The capability of a substance to act as a deflocculant will partly depend on the solids/liquid phase combination. However, especially preferred are acids.

"Fatty" anions are very suitable deflocculants, and a particularly preferred class of deflocculants comprises anionic surfactants. Although anionics which are salts of alkali or other metals may be used, particularly preferred are the free acid forms of these surfactants (wherein the metal cation is replaced by an $H^+$ cation, i.e. proton). These anionic surfactants include all those classes, sub-classes and specific forms described in the aforementioned general references on surfactants, viz, Schwartz & Perry, Schwartz Perry and Berch, McCutcheon's, Tensid-Taschenbuch; and the free acid forms thereof. Many anionic surfactants have already been described hereinbefore. In the role of deflocculants, the free acid forms of these are generally preferred.

In particular, some preferred sub-classes and examples are the $C_{10}$–$C_{22}$ fatty acids and dimers thereof, the $C_8$–$C_{18}$ alkylbenzene sulphonic acids, the $C_{10}$–$C_{18}$ alkyl- or alkylether sulphuric acid monoesters, the $C_{12}$–$C_{18}$ paraffin sulphonic acids, the fatty acid sulphonic acids, the benzene-, toluene-, xylene- and cumene sulphonic acids and so on. Particularly are the linear $C_{12}$–$C_{18}$ alkylbenzene sulphonic acids.

As well as anionic surfactants, zwitterionic-types can also be used as deflocculants. These may be any described in the aforementioned general surfactant references. One example is lecithin.

The level of the deflocculant material in the composition can be optimised by the means described in the aforementioned EP-A-266199, but in very many cases is at least 0.0%, usually 0.1% and preferably at least 1% by weight, and may be as high as 15% by weight. For most practical purposes, the amount ranges from 2–12%, preferably from 4–10% by weight, based on the final composition.

Other ingredients comprise those remaining ingredients which may be used in liquid cleaning products, such as fabric conditioning agents, enzymes, perfumes (including deoperfumes), micro-biocides, colouring agents, fluorescers, soil-suspending agents (anti-redeposition agents), corrosion inhibitors, enzyme stabilising agents, and lather depressants.

Amongst the fabric conditioning agents which may be used, either in fabric washing liquids or in rinse conditioners, are fabric softening materials such as fabric softening clays, quaternary ammonium salts, imidazolinium salts, fatty amines and cellulases.

Enzymes which can be used in liquids according to the present invention include proteolytic enzymes, amylolytic enzymes and lipolytic enzymes (lipases). Various types of proteolytic enzymes and amylolytic enzymes are known in the art and are commercially available. They may be incorporated as "prills", "marumes" or suspensions e.g. Preferably enzymes are added as supensions in a non-aqueous liquid surfactant. The preferred level of enzyme materials is from 0.01 to 2% by weight of the composition.

The fluorescent agents which can be used in the liquid cleaning products according to the invention are well known and many such fluorescent agents are available commercially. Usually, these fluorescent agents are supplied and used in the form of their alkali metal salts, for example, the sodium salts. The total amount of the fluorescent agent or agents used in a detergent composition is generally from 0.02–2% by weight.

When it is desired to include anti-redeposition agents in the liquid cleaning products, the amount thereof is normally from about 0.1% to about 5% by weight, preferably from about 0.2% to about 2.5% by weight of the total liquid composition. Preferred anti-redeposition agents include carboxy derivatives of sugars and celluloses, e.g. sodium carboxymethyl cellulose, anionic poly-electrolytes, especially polymeric aliphatic carboxylates. or organic phosphonates.

Non-aqueous liquid detergent compositions for use in accordance to the present invention are conveniently packed in a container of say 2–50 liters, more preferably 3–25 liters, most preferably 5–15 liters. Said container may be of any suitable packaging material, although disposable packaging materials such as coated carton boxes are preferred. Generally the containers will be provided with a visual indication of the preferred use of the contained materials in a domestic automatic dosing washing machine. Generally the containers will also be provided with means (such as a specific opening) for attaching the container to the washing machine, or for pouring the detergent composition into one of the reservoirs of the washing machine.

Conveniently the bleach component for use in conjunction with the non-aqueous liquid detergent composition is sold in a separate container. Preferably said container contains a liquid bleach formulation comprising from 5–80% by weight of bleach materials in combination with 20–95% by weight of water or other solvent and optionally 0–30% of other materials such as stabilisers for the bleach, thickeners etc. The bleach formulation is preferably packed in a container having a volume of 0.5–15 liters, said container preferably being provided with a visual indication indicating the use of the bleach liquid in a domestic automatic dosing system.

In use the container with the non-aqueous liquid detergent will be connected to or emptied into the automatic dosing washing machine. Preferably the method of connecting or the method of emptying is such that contact between the non-aqueous liquid detergent composition and any water is minimised.

Generally the amount of detergent composition to be used per wash cycle will be from 10 to 200 mls, more preferred 20–120 mls, more preferably 40–90 mls. If a separate bleach component is used, the amount of this used per wash cycle is generally from 0–300 mls, more generally 10–200 mls.

The invention will further be illustrated by means of the following examples.

EXAMPLE I

The following compositions (percent by weight) were prepared by mixing the ingredients in the order stated. The ingredients were milled after mixing to give a mean particle size of 5 Im.

| EXAMPLE NO: I | |
|---|---|
| Nonionic[3] | 29.4 |
| Nonionic[4] | 14 |
| Glyceroltriacetate | 5 |
| ABSA[5] | 6 |
| Na carbonate | 18 |
| Calcite | 8 |

-continued

| EXAMPLE NO: I | |
|---|---|
| Na perborate monohydrate | 10.5 |
| TAED | 3 |
| Mg oxide[2]) | 1 |
| Sipernat D 17[1]) | 2 |
| Tinopal DMS-X | 0.3 |
| Silicones DB 100 | 0.8 |
| Enzymes (Savinase/Lipolase) | 0.7 |
| Perfume | balance |

[1]Hydrophobically modified silica
[2]MgO-170 having a bulk density of about 560 g/l, particle size 2-25 Im.
[3]Narrow range ethoxylate Novel II 1012-61.5 ex Vista)
[4]Synperonic A3 ex ICI
[5]Linear $C_{12}$ alkyl benzene sulphonic acid.

The composition was packed in a labelled 2.5 liter bag-in-box container, provided with a cap specifically adapted to one of the filling openings in the Siwamat plus domestic automatic dosing washing machine.

EXAMPLE II

The following composition was prepared and packed as in example I:

| Ingredient (% wt) | |
|---|---|
| Synperonic A7 | 20.8 |
| Synperonic A3 | 16.8 |
| Dobs-acid | 5.9 |
| glyceroltriacetate | 4.9 |
| silicone | 1.2 |
| sodiumcarbonate | 7.3 |
| zeolite (wessalith 4P) | 33.3 |
| SCMC | 1.0 |
| fluorescer | 0.2 |
| Sokalan CP5 | 3.9 |
| Sipernat D17 | 2.0 |
| Lecithin | 1.5 |

-continued

| Ingredient (% wt) | |
|---|---|
| enzymes | 1.5 |

The composition had a viscosity of 2,000 mPa.s at 21 $s^{-1}$ and is free of bleach ingredients.

The above formulation was used in a Siwamat plus electric domestic automatic dosing washing machine. A second bleach containing liquid formulation (Proxsol ex ICI a 65% by weight perborate suspension in water) was used in a second reservoir of the automatic dosing system.

We claim:

1. A process for washing fabrics which process comprises using an isotropic substantially non-aqueous detergent in a domestic automatic dosing washing machine, wherein the non-aqueous liquid detergent composition has a viscosity of less than 5.0 Pa.s at $21S^{-1}$ and comprises:

(a) 35–90% nonionic surfactant;
(b) 0–20% liquid bleach activator;
(c) 0–20% solvents other than nonionic surfactants;
(d) 0–50% builder;
(e) 0–15% deflocculants; and
(f) 0–5% water;

all percentages being by weight of the composition.

2. Process according to claim 1, wherein the non-aqueous liquid detergent composition is contained in a container having a volume of from 2–50 liters, said container being connected to the washing machine, and wherein the amount of non-aqueous liquid detergent used per wash cycle is 10–200 mls.

3. Process according to claim 1, wherein the non-aqueous liquid detergent composition is substantially free of bleach ingredients and the bleach is dosed as a separate ingredient.

* * * * *